US006481601B1

(12) United States Patent
Steen

(10) Patent No.: US 6,481,601 B1
(45) Date of Patent: Nov. 19, 2002

(54) SELF-SEALING SOLVENT BOTTLE CAP INSERT

(75) Inventor: Kevin John Steen, Augusta, KS (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/853,119

(22) Filed: May 10, 2001

(51) Int. Cl.[7] ..... B65D 5/00

(52) U.S. Cl. ..... 222/500; 222/460; 222/547; 222/564; 215/22

(58) Field of Search ..... 222/460, 462, 222/500, 547, 564; 215/22

(56) References Cited

U.S. PATENT DOCUMENTS

| | | | | | |
|---|---|---|---|---|---|
| 208,690 | A | | 10/1878 | Newton | |
| 316,147 | A | | 4/1885 | Heysinger | |
| 574,013 | A | * | 12/1896 | Thatcher | 222/500 |
| 1,977,414 | A | | 10/1934 | Testa | |
| 2,437,882 | A | * | 3/1948 | Mallick | 222/500 |
| 2,578,201 | A | | 12/1951 | Nicorco | |
| 2,974,833 | A | * | 3/1961 | Heppenstall | 222/500 |
| 3,111,244 | A | * | 11/1963 | Mills | 222/500 |
| 3,539,076 | A | * | 11/1970 | Weiss | 222/500 |
| 3,779,429 | A | * | 12/1973 | Pocelli | 222/500 |
| 3,792,803 | A | | 2/1974 | Kessler | |
| 3,794,202 | A | * | 2/1974 | Unger | 222/500 |
| 4,741,448 | A | | 5/1988 | Alley et al. | |
| 4,979,654 | A | | 12/1990 | Nohren, Jr. | |
| 5,515,892 | A | | 5/1996 | Najafi et al. | |
| 5,996,860 | A | | 12/1999 | Alley | |
| 6,179,219 | B1 | * | 1/2001 | Lin | 222/500 |

* cited by examiner

*Primary Examiner*—J. Casimer Jacyna
(74) *Attorney, Agent, or Firm*—Harness Dickey & Pierce P.L.C.

(57) ABSTRACT

An insert is positioned in an opening in a fluid container and between a closure member and the fluid container. The insert generally includes a funnel and an obstructive member disposed therewithin. The insert inhibits evaporative emissions from the fluid container by seating against a conical body portion of the funnel when the fluid container is in an upright or storage position. When the fluid container is in a tilted or use position, the obstructive member locates to an outlet end of the funnel to create a passage from an inlet end of the funnel to the outlet end.

18 Claims, 2 Drawing Sheets

SELF-SEALING SOLVENT BOTTLE CAP INSERT

FIELD OF THE INVENTION

The present invention relates generally to fluid dispensing bottles and, more particularly, to a self-sealing bottle cap insert.

BACKGROUND

Fluid containers are commonly used for general-purpose storage and dispensing of fluid. Conventional fluid containers are often fitted with a cap having an open spout or a closeable spout, such as an articulating spout movable between an open and closed position.

In manufacturing and testing facilities, improper fluid storage can present an environmental hazard. For example, the fluid contained in a container may emit vapors that escape into the environment. A cap with an open spout provides a passageway for such vapors to escape while the container is in an upright, storage position. A cap having a closeable spout left in an open position will also allow vapors to escape therethrough and into the environment.

SUMMARY OF THE INVENTION

A fluid container that prevents vapors from escaping while in an upright or storage position without the need to close a spout and also allow fluid to pour through the spout when in a tilted or use position without the need to open a spout eliminates or reduces the hazard of escaping harmful vapors while providing a fluid container that is simple to use and seal. An insert according to the invention is positioned between a container opening and a closure member to automatically seal the container when in the storage or upright position. The insert includes a funnel and an obstructive member. The obstructive member and the funnel cooperate to selectively inhibit the emission of vapors from the container.

In an exemplary embodiment, an insert is positioned between an opening in a container and a closure member releasably secured to the container. The insert includes a funnel having a conical body portion with an inlet end and an outlet end. The outlet end, which is positioned adjacent the closure member, has a larger diameter than the inlet end, which is disposed within the container. An obstructive member having a larger diameter than the inlet end is disposed within the funnel. The insert is operable such that the obstructive member seats against the conical body portion of the funnel when the container is in an upright position to inhibit the emission of vapors. When the container is inverted, the obstructive member relocates toward the outlet end of the funnel to create a passage from the inlet end to the outlet end of the insert.

Further areas of applicability of the present invention will become apparent from the detailed description provided hereinafter. It should be understood however that the detailed description and specific examples, while indicating a preferred embodiment of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
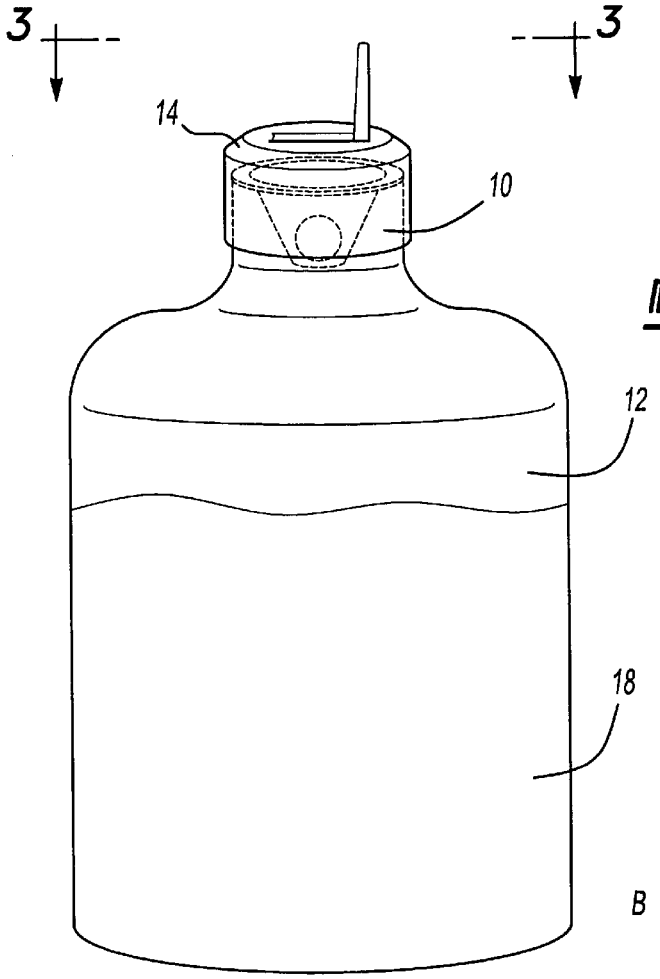
FIG. 1 is a perspective view of a container including a cap insert according to the invention;.

With initial reference to the environmental view of FIG. 1, an insert for sealing a fluid container is illustrated and generally identified at reference 10. The insert 10 is shown operatively associated with a fluid container having a closure member; specifically a conventional solvent bottle 12 having a cap 14. Insert 10 is adapted to sealably interfit between bottle 12 and cap 14. As will be explained in greater detail, insert 10 prevents fumes or vapors 16 from escaping bottle 12 through cap 14 while the bottle 12 is in an upright or storage position. Insert 10 is also configured to allow fluid 18 to pour out of the bottle 12 through the cap 14 while the bottle 12 is in a tilted or use position.

Figure 2:
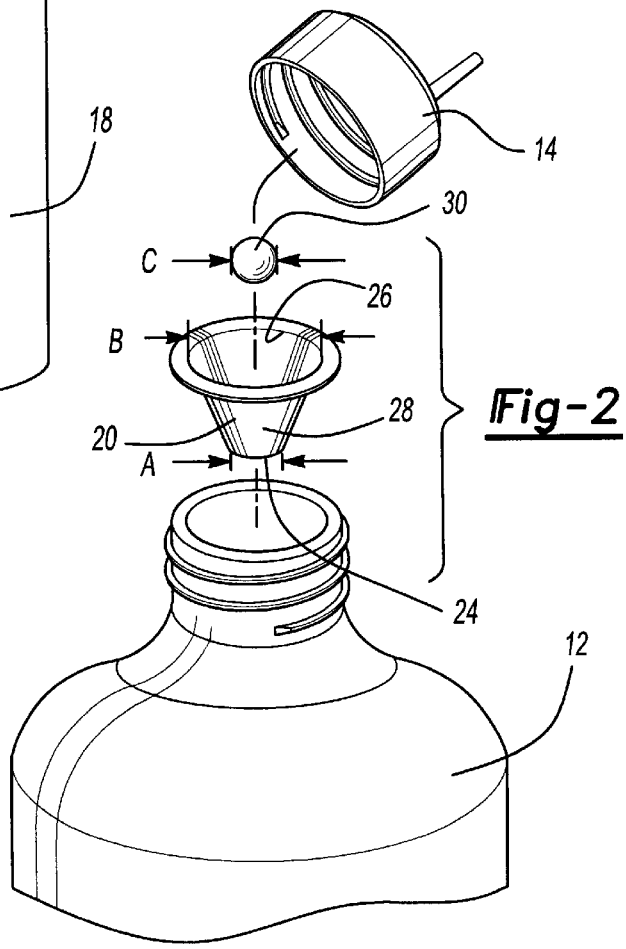
FIG. 2 is a partial exploded view of the container and cap insert of FIG. 1.
Figure 3:
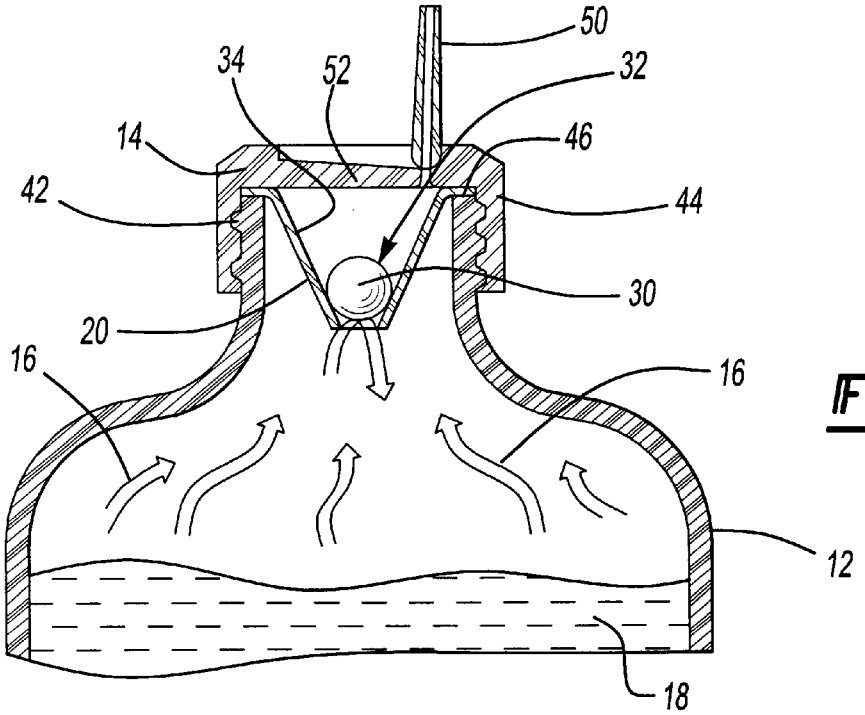
FIG. 3 is a sectional view taken along line 3—3 of FIG. 1 shown with the container in an upright or storage position.

With continued reference to FIG. 1 and additional reference to FIGS. 2 and 3, the insert 10 of the present invention will be further described. Insert 10 is shown to generally include a funnel 20 and obstructive member, which is preferably a sphere such as ball 30. Funnel 20 includes narrower inlet end 24 connected to a wider outlet end 26 by conical body portion 28. An annular flange 46 surrounds the outlet end 26 and preferably has an outer diameter selected to press fit within a radial flange of the cap 14. The opening for inlet 24 has a diameter A that is smaller than diameter B for the opening for outlet 26. Ball 30 has a diameter C larger than diameter A, such that ball 30 may rest in a portion of the funnel 20 having an equivalent diameter to form a seal with the wall 34 of conical body portion 28 when the bottle 12 is in an upright or storage position.

Funnel 20 is preferably constructed of material complimentary to the material used in a conventional solvent bottle 12, such as polypropylene or polyethylene. Ball 30 is constructed from a material having a density greater than the evaporative fumes or vapors of the fluid in the container 12. A preferred material is stainless steel. One skilled in the art will recognize that ball 30 may be constructed from any material having a density greater than the evaporative fumes or vapors, thus assuring radial contact of the surface 32 of the ball 30 with the wall 34 of conical body portion 28 when the bottle 12 is in an upright position.

Figure 4:
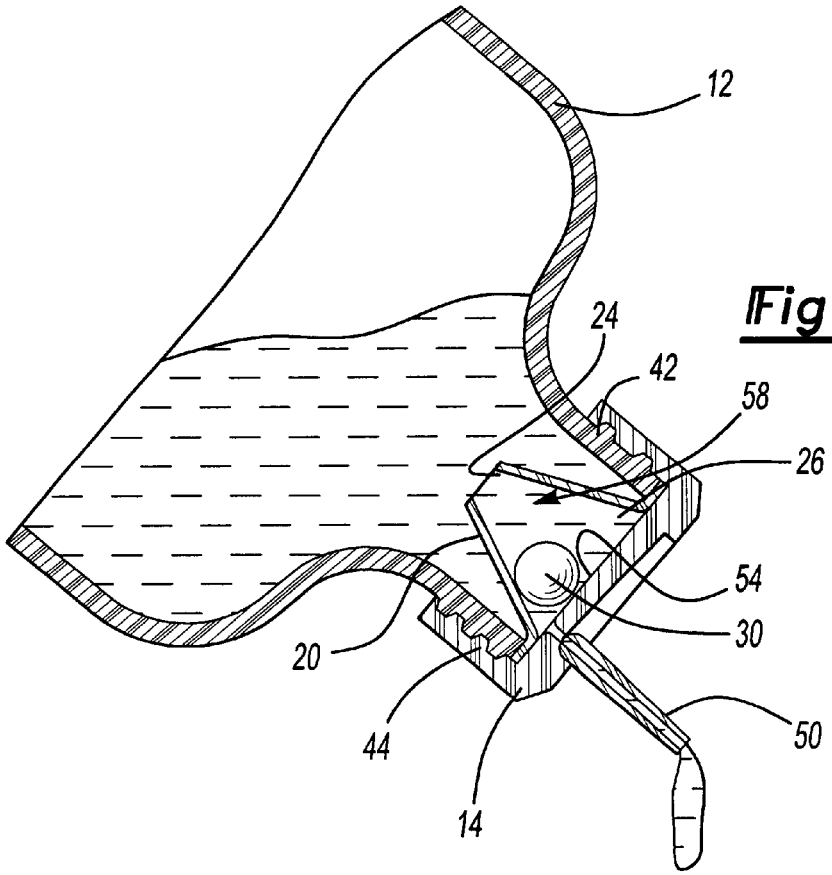
FIG. 4 is a sectional view of the container of FIG. 3 in a tilted or use position.

Referencing FIGS. 3 and 4, insert 10 is adapted to be suitably inserted within radial flange or skirt 44 of cap 14. Explained further, the outwardly extending annular flange 46 of the funnel 20 is preferably configured to be press fit against the upper portion of the inner diameter surface of the skirt 44 of cap 14 to retain the insert 10 therewithin. The skirt 44 of cap 14 is threadably secured to the throat 42 of bottle 12 to seal the cap 14 to the bottle 12 with the insert 10 secured between skirt 44 of the cap 14 and the throat 42 of the bottle 12. Cap 14 optionally includes an articulating spout 50 interconnected to top portion 52. Spout 50 is exemplary in nature, and the cap 14 may include other types of spouts or nozzles, whether stationary or closeable.

The operation of insert 10 with bottle 12 and cap 14 will now be described in further detail. When bottle 12 is in an upright or storage position (FIG. 3), ball 30 rests in the conical body portion 28 of the funnel 20 at a portion having a diameter equivalent to the ball 30. As such, ball 30 seats against the wall 34 of the funnel 20 to prevent vapors 16 evaporating from the fluid 18 from escaping the bottle 12 through spout 50. When the bottle 12 is tilted to dispense the fluid 18, or in a use position (FIG. 4), the ball 30 locates to the outlet end 26 of the funnel 20, thereby making contact with the cap 14 at surface 54 and allowing fluid 18 to flow through the inlet end 24 of the funnel 20 to the outlet end 26 of the funnel 20, and ultimately through the spout 50 of the cap 14. Specifically, the fluid 18 freely flows around the ball 30 to the outlet end 26 of the funnel 20. Returning of the bottle 12 to its upright position causes the ball 30 to return to the equivalent diameter portion of the conical body portion 28 of the funnel 20 to prevent evaporative fumes 16 from escaping the bottle 12.

In the exemplary embodiment, funnel 20 includes an inlet diameter A of 0.1875 inches, an outlet diameter B of 0.750 inches, or a diametric ratio of 1:4. The annular flange 46 has a diameter of approximately 1.030 inches. The inlet end 24 and outlet end 26 are axially displaced approximately 0.550 inches. Conical body portion 28 is constructed of 0.045 inch thick polypropylene material. Ball 30 has a diameter C of 0.250 inches, which is one-third larger than inlet diameter A.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An insert adapted to be positioned between an opening in a container and a closure member releasably secured to the container, the closure member having a closure opening offset toward an outer boundary thereof, said insert comprising:

a conical body extending from an inlet and terminating at an outlet, said outlet having a larger diameter opening than said inlet, said conical body uniformly tapering from said outlet to said inlet; and an obstructive member retained within said conical body, said obstructive member having a larger diameter than said inlet and a smaller diameter than said outlet, said obstructive member seating against said conical body to inhibit vapor passage through said outlet when the container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

2. The insert of claim 1, wherein said conical body includes an annular flange surrounding said outlet and extending outwardly therefrom.

3. The insert of claim 2, wherein said annular flange is shaped complimentary to the closure member for retention thereby.

4. The insert of claim 1, wherein said obstructive member is a sphere.

5. The insert of claim 4, wherein said sphere is a steel ball.

6. The insert of claim 1, wherein said inlet and said outlet have diameters related by a ratio of approximately 1:4.

7. The insert of claim 1, wherein said obstructive member is approximately one-third larger in diameter than a diameter of said inlet.

8. A cap for a fluid container having a container opening, said cap to inhibit evaporative fumes from escaping the fluid container while the fluid container is in a storage position and allow fluid to pour from the container opening while the fluid container is in a use position, said cap comprising:

a closure member releasably secured to the container about the container opening and having a closure opening offset toward an outer boundary thereof;

a funnel having a conical body portion tapering from an outlet to an inlet, said outlet having a larger diameter opening than said inlet, and said inlet, outlet, container opening and closure opening being in fluid communication; and an obstructive member retained within said funnel by said closure member, said obstructive member having a larger diameter than said inlet and a smaller diameter than said outlet, said obstructive member seating against said conical body portion of said funnel to inhibit vapor passage through said outlet when the container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

9. The cap of claim 8, wherein said obstructive member is a sphere.

10. The cap of claim 9, wherein said sphere is a stainless steel ball.

11. A cap for a fluid container having a container opening, said cap to inhibit evaporative fumes from escaping the fluid container while the fluid container is in a storage position and allow fluid to pour from the container opening while the fluid container is in a use position, said cap comprising:

a closure member releasably and threadably secured to the container about the container opening and having a closure opening offset toward an outer boundary thereof;

a funnel having a conical body portion tapering from an outlet to an inlet, said outlet having a larger diameter opening than said inlet, and said inlet, outlet, container opening and closure opening being in fluid communication; and an obstructive member disposed within said funnel, said obstructive member having a larger diameter than said inlet and a smaller diameter than said outlet, said obstructive member seating against said conical body portion of said funnel to inhibit vapor passage through said outlet when the container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

12. A cap for a fluid container having a container opening, said cap to inhibit evaporative fumes from escaping the fluid container while the fluid container is in a storage position and allow fluid to pour from the container opening while the fluid container is in a use position, said cap comprising:

a closure member releasably secure d to the container about the container opening and having a closure opening offset toward an outer boundary thereof;

a funnel having a conical body portion tapering from an outlet to an inlet, said outlet having a larger diameter opening than said inlet, said funnel including an annular flange surrounding said outlet and extending outwardly from said conical body portion, said inlet, outlet, container opening and closure opening being in fluid communication; and an obstructive member disposed within said funnel, said obstructive member having a larger diameter than said inlet and a smaller diameter than said outlet, said obstructive member seating against said conical body portion of said funnel to inhibit vapor passage through said outlet when the container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

13. A cap for a fluid container having a container opening, said cap to inhibit evaporative fumes from escaping the fluid container while the fluid container is in a storage position and allow fluid to pour from the container opening while the fluid container is in a use position, said cap comprising:

a closure member releasably secured to the container about the container opening and having a closure opening offset toward an outer boundary thereof;

a funnel having a conical body portion tapering from an outlet to an inlet, said outlet having a larger diameter opening than said inlet, said funnel including an annular flange surrounding said outlet and extending outwardly from said conical body portion, wherein said annular flange of said funnel is press fit into a radial flange of said closure member, and said inlet, outlet, container opening and closure opening being in fluid communication; and an obstructive member disposed within said funnel, said obstructive member having a larger diameter than said inlet and a smaller diameter than said outlet, said obstructive member seating against said conical body portion of said funnel to inhibit vapor passage through said outlet when the container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

14. A fluid container operable to inhibit evaporative fumes from escaping while in a storage position and allow fluid to pour therefrom while in a use position, said fluid container comprising:

a container body defining a container opening;

a closure member having a closure opening offset toward an outer boundary thereof and releasably secured to said container body about said container opening;

a funnel having a conical body portion between an inlet and an outlet, said outlet having a larger diameter opening than said inlet and said conical body tapering from said outlet to said inlet; and an obstructive member retained within said funnel by said closure member, said obstructive member having a larger diameter than said inlet, said obstructive member seating against said conical body portion of said funnel to inhibit vapor passage through said outlet when said fluid container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

15. The fluid container of claim 14, wherein said obstructive member is a sphere.

16. The fluid container of claim wherein said sphere is a stainless steel ball.

17. A fluid container operable to inhibit evaporative fumes from escaping while in a storage position and allow fluid to pour therefrom while in a use position, said fluid container comprising:

a container body defining a container opening;

a closure member having a closure opening offset toward an outer boundary thereof and releasably secured to said container body about said container opening;

a funnel having a conical body portion between an inlet and an outlet, said outlet having a larger diameter opening than said inlet and said conical body tapering from said outlet to said inlet, said funnel including an annular flange surrounding said outlet and extending outwardly from said conical body portion; and an obstructive member disposed within said funnel, said obstructive member having a larger diameter than said inlet, said obstructive member seating against said conical body portion of said funnel to inhibit vapor passage through said outlet when said fluid container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

18. A fluid container operable to inhibit evaporative fumes from escaping while in a storage position and allow fluid to pour therefrom while in a use position, said fluid container comprising:

a container body defining a container opening;

a closure member having a closure opening offset toward an outer boundary thereof and releasably secured to said container body about said container opening;

a funnel having a conical body portion between an inlet and an outlet, said outlet having a larger diameter opening than said inlet and said conical body tapering from said outlet to said inlet, said funnel including an annular flange surrounding said outlet and extending outwardly from said conical body portion, wherein said annular flange of said funnel is press fit into a radial flange of said closure member; and an obstructive member disposed within said funnel, said obstructive member having a larger diameter than said inlet, said obstructive member seating against said conical body portion of said funnel to inhibit vapor passage through said outlet when said fluid container is in a first orientation, said obstructive member movable to a second orientation wherein a first portion of said obstructive member engages said conical body and a second portion of said obstructive member engages said closure member inboard of the closure opening to allow passage of fluid from said inlet to said outlet.

* * * * *